United States Patent [19]

Fischer et al.

[11] 4,312,283

[45] Jan. 26, 1982

[54] AUTOMATIC SEWING MACHINE HAVING CONTROL CIRCUIT RECEIVING A SIGNAL MEASURING ADJUSTMENT OF WORK RECEIVING MEANS

[75] Inventors: Jochen Fischer, Bielefeld; Hans Scholl, Oerlinghausen-Lipperreihe, both of Fed. Rep. of Germany

[73] Assignee: Kochs Adler AG, Bielefeld, Fed. Rep. of Germany

[21] Appl. No.: 156,373

[22] Filed: Jun. 4, 1980

[30] Foreign Application Priority Data

Sep. 20, 1979 [DE] Fed. Rep. of Germany ..... 2938064

[51] Int. Cl.[3] ..... D05B 21/00; D05B 39/00

[52] U.S. Cl. ..... 112/121.12

[58] Field of Search ..... 112/121.12, 121.11, 112/121.15, 121.14, 102, 103

[56] References Cited

U.S. PATENT DOCUMENTS

| | | | |
|---|---|---|---|
| 3,739,733 | 6/1973 | Schramayr | 112/121.12 |
| 4,069,778 | 1/1978 | Kozawa | 112/121.12 |
| 4,201,144 | 5/1980 | Manabe et al. | 112/121.12 |

*Primary Examiner*—Peter P. Nerbun

*Attorney, Agent, or Firm*—Max Fogiel

[57] ABSTRACT

An automatic sewing machine for sewing workpieces of different sizes is described, in which relative movement between a workpiece and the needle of a sewing head is controlled by a computer receiving the program according to the contour to be stitched. A measuring device is provided for automatically matching the relative movement of the sewing process with the size adjustable workpiece receiving elements. The measuring device continuously detects the size adjustment of the workpiece receiving elements and feeds the size adjustment into an adapting electronic unit converting analog information into digital information used by the computer controlling the stitching operation.

8 Claims, 7 Drawing Figures

Fig. 1
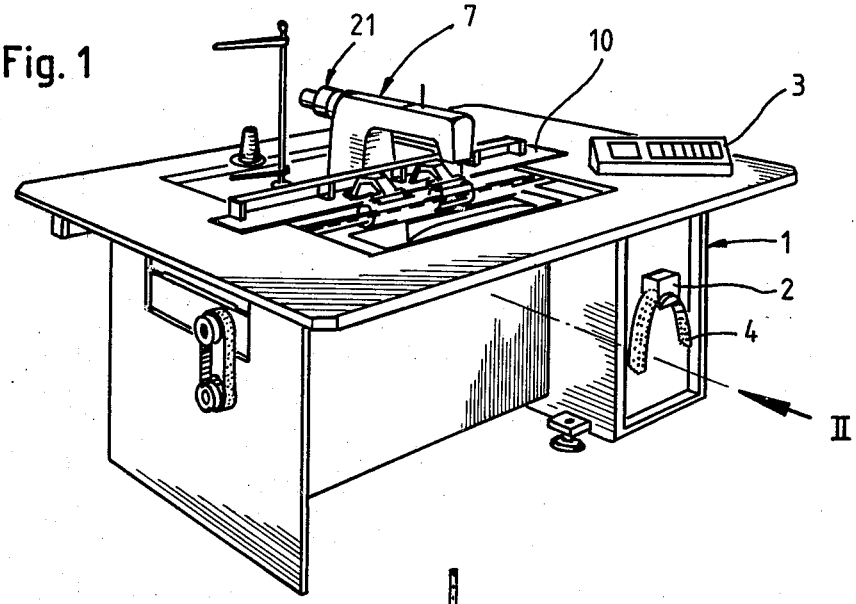
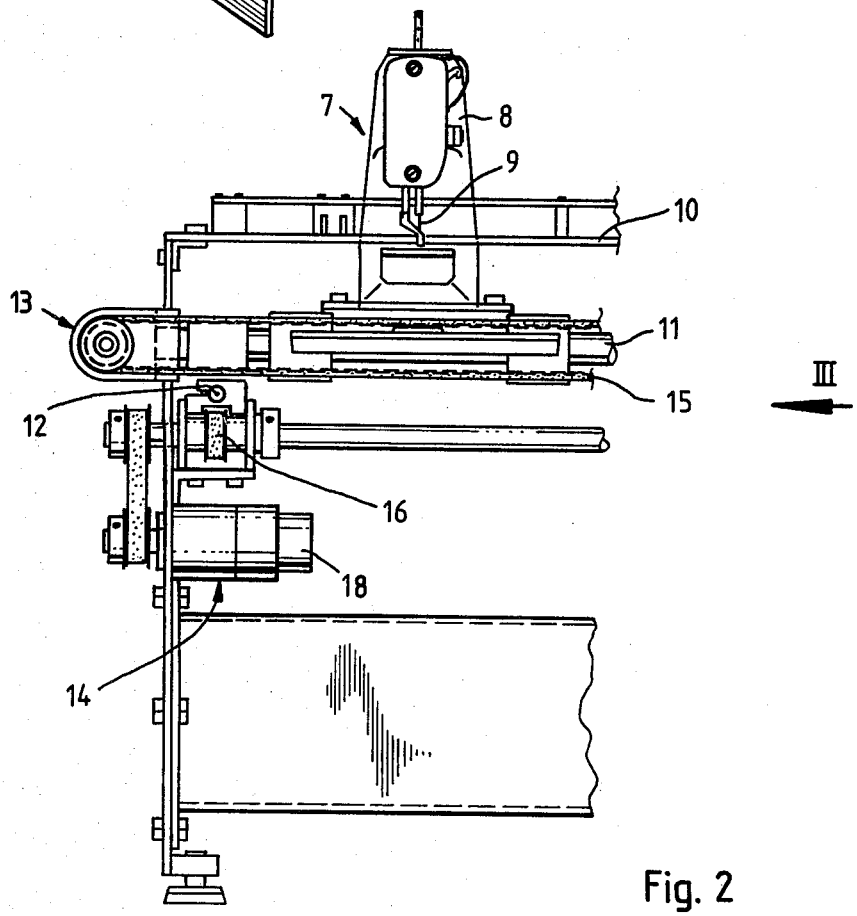
Fig. 2

1
60
61
57
59
62
58
56
55
54
40
5
6
10
23
24
25
27
29
30
31
32
33
34
35
36
38
41
42
43
44
45
46
47
48
49
50
51
52
53

AUTOMATIC SEWING MACHINE HAVING CONTROL CIRCUIT RECEIVING A SIGNAL MEASURING ADJUSTMENT OF WORK RECEIVING MEANS

BACKGROUND OF THE INVENTION

The present invention relates to an automatic sewing machine for sewing workpieces of different sizes, in which relative movement between a workpiece and a sewing head is controlled by a computer which receives a program according to a contour to be stitched.

In general, it is known from the manufacturing of workpieces such as shirt collars, to achieve different sizes by inserting an extending section into the middle of the collar, while the shape in the area of the collar tips remains the same.

In a technical information sheet named "IDEAL-NECCHI AUTOMATION FOR THE APPAREL INDUSTRY Mechanization Series Class 2001 Numerical Control Automatic Unit for producing any sewing shape" edited by the IDEAL EQUIPMENT CO. LTD., Quebeck/Canada, there is described such an automaton, in which the program for producing a stitch contour is inserted into the computer by means of punched tape. The data of the contour is determined by coordinates of some significant points which represent the variables of an algorithm applied for figuring all required values of the contour by using linear or square interpolation. Additionally, the algorithm considers besides the aforementioned variables, further information for determining the size of the contour to be sewn. In this automaton the size adjustment depending on the size adjustment of the workpiece receiving device, is manually inserted into the computer by means of appropriate push buttons at a panel. The manual input of the sizing information basically allows the operator to match the sewing contour to different workpiece sizes, with, however, accompanying disadvantages. On the one hand, sizes of garments are not standardized in such a way as to form fixed sizes to each other but, in practice, vary depending on the manufacturer. At the same time, the material of a workpiece is exposed to various influences such as for example coloring, moisture, fusing of lining etc. which cause undesired variations of the workpiece dimensions. In production, these conditions steadily require manual size adjustments according to the actual workpiece dimensions. As described above, the contour's size is manually inserted into the computer by push buttons, whereas the adjustment of the workpiece receiving elements can be set in a stepless manner. From this it may happen that a contour is not placed at the technologically required position. Such conditions may cause sewing into the fused lining of a workpiece such as a shirt collar, and this is not acceptable. Besides this disadvantage, the nonautomatic input of information into the computer is time consuming and reduces the productivity of the automaton.

It is, therefore, an object of the present invention to provide an automatic sewing machine of the above-described type with a device for detecting the size adjustment of the workpiece receiving device, in order to automatically match the size adjustment with the sewing contour controlled by the computer which controls relative motion between the workpiece and the needle of the sewing head.

Another object of the present invention is to provide a device, as described, which allows to detect the size adjustment of the workpiece-receiving device in a continuous manner.

Further objects of the present invention are to provide a device, as described, for reducing downtimes of the automaton and eliminating false data input of the machine's operator, and finally eliminating the possibility of collision between the sewing head and the workpiece receiving elements.

Still another object of the present invention is to provide a device of the foregoing character, which is simple in construction and reliable in operation.

SUMMARY OF THE INVENTION

The objects of the present invention are achieved by providing the workpiece receiving device with a measuring device for detecting the size adjustment and automatically informing the computer controlling the machine. The measuring device facilitates a fine adaption of the stitched contour to the workpiece, and eliminates additional actions of the operator related to size adjustments.

By using a measuring device having a linear characteristic, the size adjustment of the workpiece receiving device equals or corresponds to the necessary information for the computer, without any additional data conversion. This simplifies the total arrangement and positively affects the processing time.

The application of a potentiometer as the essential element within the measuring device optimally meets the requirements for linear measurement and is, furthermore, a standardized interchangeable item. The mechanical linkage of the potentiometer by means of a rack and pinion guarantees a slipless and rigid drive.

The arrangement of a separate power supply for the measuring device allows for adaption to the characteristic of the potentiometer and the data processing circuit. The application of an AD-converter within the adapting electronic unit prevents the feeding of analog information over long distances.

Other objects, advantages and features of the present invention will appear from the detailed description of the preferred embodiment, which will now be explained in conjunction with the accompanying drawings.

BRIEF DESCRIPTION OF THE DRAWINGS

FIG. 1 is a perspective total view of an automatic sewing machine;

FIG. 2 is a partial front plane view of the automatic sewing machine in the direction of arrow II in FIG. 1;

DESCRIPTION OF THE PREFERRED EMBODIMENT

Figure 3:
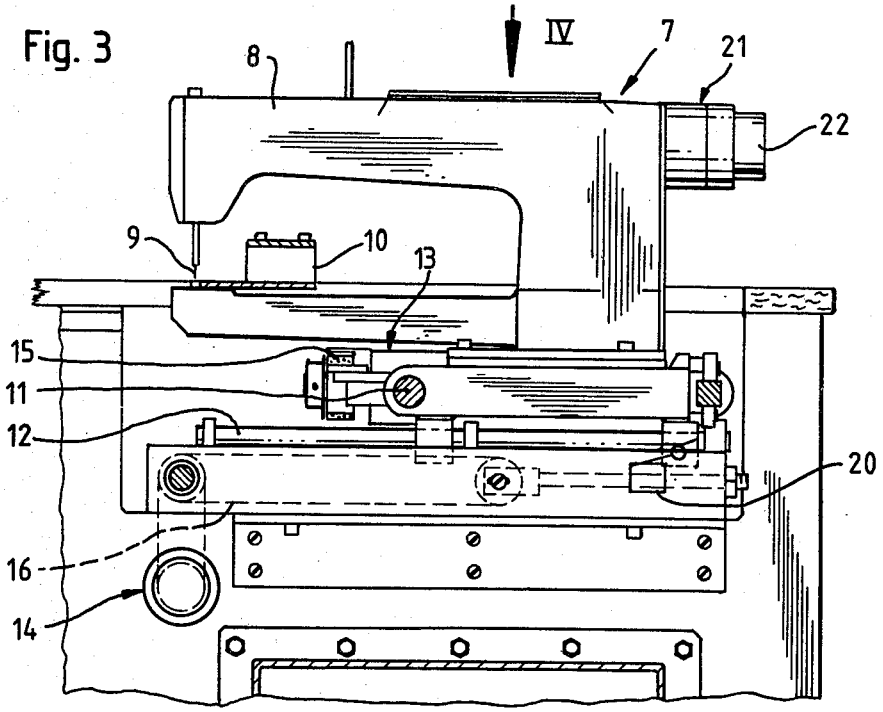
FIG. 3 is a partial side view of the sewing machine in the direction of arrow III in FIG. 2.

Referring more particularly to the drawings, in FIG. 1 there is illustrated an automatic sewing machine 7 for producing shirt collars of different sizes, which is controlled by a computer 1 having a tape reader 2. The functions of the computer 1 are manually released by means of a panel 3. Prior to a sewing cycle, the tape reader 2 is loaded with a control tape 4, having coded information which is read into the computer 1 as soon as the command is inserted into the panel 3.

Besides coded information for a workpiece receiving device 5 (FIG. 6) receiving a workpiece 6, the tape 4 carries information about significant points defining a sewing contour to be controlled. For the seam to be produced, these significant points are fed into the computer 1 as X-Y-coordinates which represent parameters for the algorithm of computation, in order to calculate the remaining points of the contour by applying linear or square interpolation. Moreover, information of special points of the contour are read into the computer 1, as for example, the corners of collar tips, so that, after reaching such significant points, the computer logic is capable to branch the program for considering the complicated control operation adjacent to these points. Furthermore, the tape 4 delivers information to the computer 1, for which, at sections of the contour, additionally offered parameters have to be considered. Among other things, such parameters define the continuous sizing for adaption to the different manufacturing sizes. These parameters are considered by the computer 1 in the contour sections as provided by the tape 4.

Figure 4:
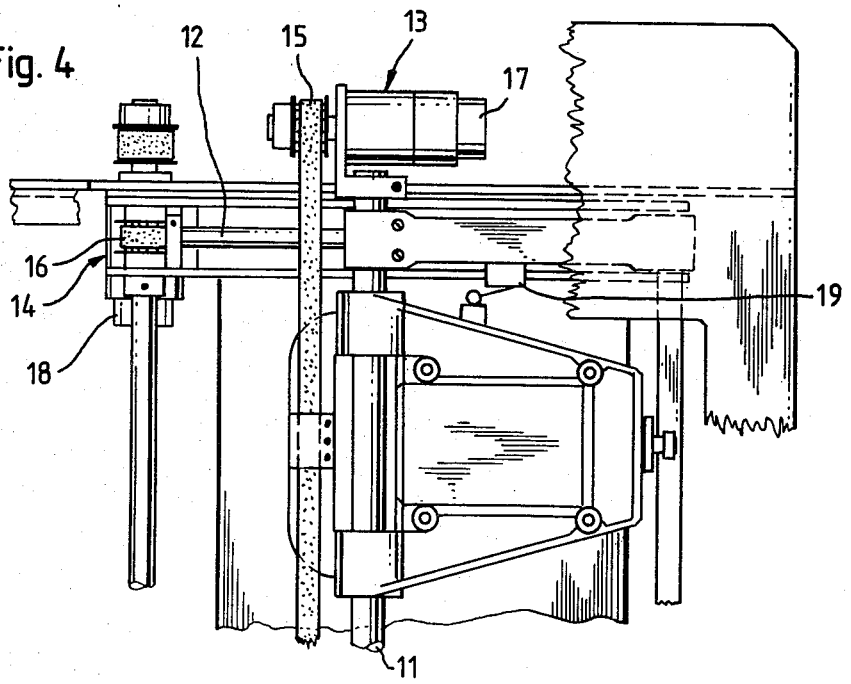
FIG. 4 is a partial top plan view of the sewing machine in the direction of arrow IV in FIG. 3, without sewing head however.

According to FIGS. 2 and 3, the automatic sewing machine 7 is equipped with a sewing head 8 carrying a needle 9. The workpiece receiving device 5 is secured to a stationary bracket 10. As shown in FIGS. 2, 3 and 4, the sewing head 8 is moveably arranged on two guide bars 11 (X-direction) and 12 (Y-direction) which are horizontal and perpendicular to each other, and installed so as to allow the sewing head 8 to move in a horizontal plane. The sewing head 8 is drivingly connected by timing belts 15, 16 to servo motors 13, 14.

The servo motors 13, 14 are equipped with encoders 17, 18 (FIGS. 2 and 4), which indicate the position of the needle 9 relative to the stationary workpiece receiving device 5 in X- and Y-direction. Prior to operation, the encoders 17, 18 are calibrated in conjunction with the switches 19, 20. The sewing head 8 (FIG. 3) is driven by a sewing head drive 21 including an encoder 22 which puts out regular pulses and a zero pulse per one revolution, in order to inform the computer 1 at any time about the position of the needle 9, i.e. the angular position of the needle drive mechanism (not shown).

Figure 5:
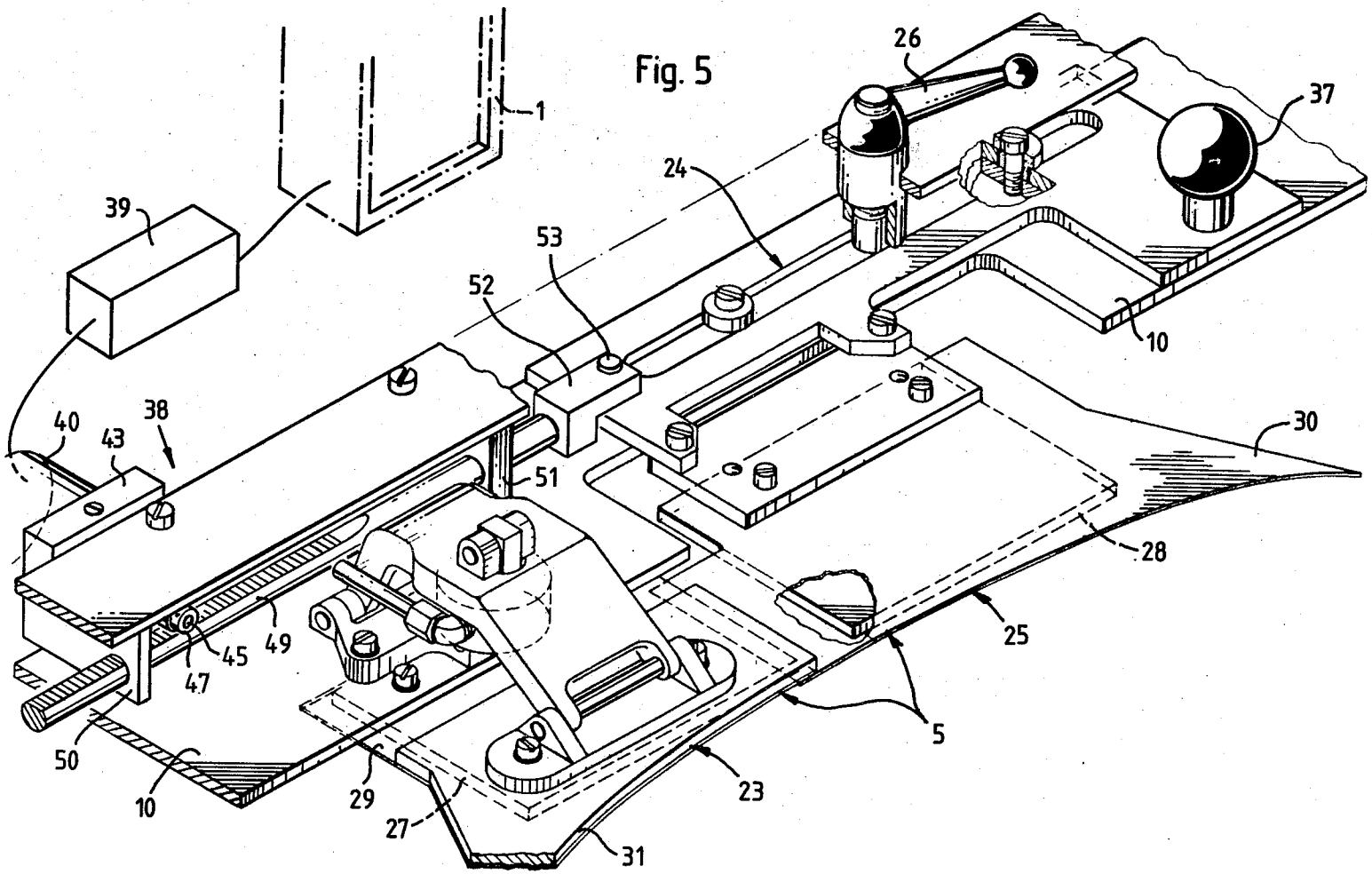
FIG. 5 is a perspective view showing the essential parts of a workpiece receiving device.
Figures 6, 7:
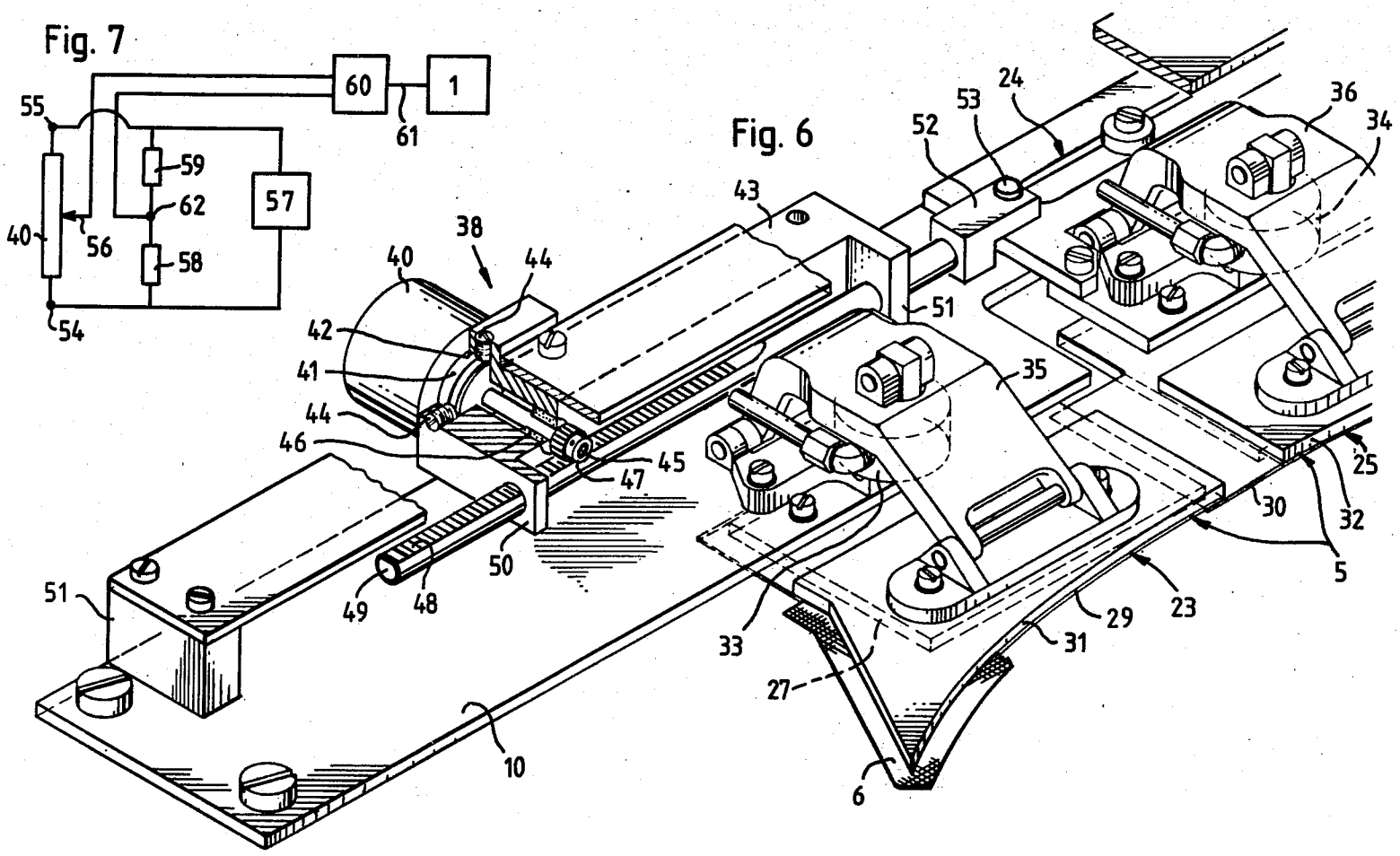
FIG. 6 is a perspective view showing the workpiece receiving device including a measuring device with a potentiometer.
FIG. 7 is a basic circuit diagram of the measuring device having a connection to a computer.

As illustrated in FIGS. 5 and 6, the workpiece receiving device 5 consists of two parts, a stationary workpiece receiving element 23 secured to the stationary bracket 10, and a movable workpiece receiving element 25 received in a guide 24 formed as an oblong hole. The movable workpiece receiving element 25 is releasably locked in the guide 24 by a handle 26. The stationary and the movable workpiece receiving elements 23, 25 are provided each with a supporting plate 27 or 28, a contoured supporting plate 29 or 30 and a congruent clamping plate 31 or 32. The contoured supporting plate 30 is shaped as to overlap the contoured supporting plate 29 for forming an uninterrupted support for the workpiece 6 at any adjusted position of the movable workpiece receiving element 25. In order to prevent a step at the overlapping, the contoured supporting plates 29, 30 are cut, for example, from sheet material having a thickness of 0.5 mm. According to FIG. 6, the clamping plates 31 and 32 are movably arranged by means of levers 35 and 36 operated by air cylinders 33 and 34. The air cylinder 33 is stationarily fixed to the bracket 10, while the air cylinder 34 is adjustably connected to the movable workpiece receiving element 25 received in the guide 24.

For adjustment purposes the movable workpiece receiving element 25 is installed with a handle 37. The position of the movable workpiece receiving element 25 is picked up or sensed by a measuring device 38 (FIG. 6). In the preferred embodiment, the measuring device 38 is arranged at the stationary workpiece receiving element 23 which is located oppositely to the movable workpiece receiving element 25. As illustrated, the stationary bracket 10 is provided with a bracket 43 having two bearings 50, 51 for slidably receiving a rack 49 which is connected to the movable workpiece receiving element 25 by means of a connecting block 52 and a bolt 53. Furthermore, the bracket 43 is formed with a recess 42, in which a flange 41 of a potentiometer is secured by means of set screws 44. The potentiometer 40 has a shaft 45 pivoted in a bushing 46 and is installed with a pinion 47 cooperating with toothing 48 of the rack 49. In order to achieve a precise position of the movable workpiece receiving element 25, the potentiometer 40 is of the type which has 10 revolutions over its measuring range.

The potentiometer 40 is connected to the computer 1 by means of an adapting electronic unit 39 which now will be described in connection with FIG. 7. The potentiometer 40 is a standard type and has two supply connections 54, 55 and a tape 56. By rotating the shaft 45, the tap 56 provides output voltages which are proportional to the supply voltage and proportional to the position of the tap 56 in relation to its final position within the potentiometer 40. The potentiometer 40 is connected to a standard power supply 57 which is commercially available with an accuracy of better than 0.01%. As illustrated, the power supply 57 is also connected to a voltage splitting device consisting of two resistors 58, 59 which have low resistance in relation to the resistance of the potentiometer 40 and are connected in series. This may be achieved without any difficulties by providing the potentiometer 40 with 100-kohm resistance in conjunction with a voltage splitting device having a total resistance of 1 kohm.

By dimensioning the resistor 58 with a value of 50 kohms, a 0-volt potential is achieved at the tap 56 without damaging the potentiometer 40 by running against its internal stops. Accordingly, the maximum voltage of 10 volts, for example, is provided at a position of the tap 56 of about 5% off the other stop even by adjusting the stationary and movable workpiece receiving elements 23 and 25 in their farthest positions to each other. An AD-converter 60 is connected to the tap 56 and a branching connection 62 for converting the analog voltage into coded digital information fed into the computer 1 by means of a circuit connection 61. Due to the drive connection of the potentiometer 40 with the stationary and movable workpiece receiving elements 23 and 25, the coded information represents an absolute dimension for the adjusted size.

The operation of the automatic sewing machine with the novel measuring device may be described as follows:

For size adjustment, the operator unlocks the handle 26 and adjusts the movable workpiece receiving element 25 by means of the handle 37 according to the dimensions of the workpiece 6, in order to achieve a suited stitch contour in relation to the fused lining of the collar. It might be necessary to make fine readjustments after the first collar has been stitched. By adjusting the movable workpiece receiving element 25, the potentiometer 40 is turned due to the cooperation of the rack 49 and the pinion 47. The adjusted position of the movable workpiece receiving element 25 is detected by the measuring device 38 at which the information is transferred via the adapting electronic unit 39 into the computer 1 as a variable to be considered during the control process. Prior to sewing, the operator firmly arrests the movable workpiece receiving element 25 by tightening the handle 26. During the sewing operation, the computer 1 obtains information about the position of the sewing head 8 in X- and Y-direction from the encoders 17 and 18, and about the position of the needle 9 from the encoder 22, while the sewing head 8 is driven by the sewing head drive 21 as the X- and Y-movements of the workpiece 6 are fed into the machine by the servo motors 13 and 14 in conjunction with the timing belts 15 and 16.

As described in the foregoing procedure of adjustment, there is enough time for the AD-converter 60 to carry out the data conversion, so that even time-consuming integrated circuits of the described kind may be applied. The computer 1 considers the coded size information, as the particular section of a stitch contour containing the size variation, is to be calculated. This arrangement allows the application of an inexpensive AD-converter.

For adjusting the measuring device 38 (FIG. 6) the power supply 57 is connected to the supply connections 54, 55 of the potentiometer 40 and to the resistors 58 and 59, as a voltmeter indicating positive and negative potential is connected to the tap 56 and the branching connection 62. For defining the zero position of the stationary and movable workpiece receiving elements 23 and 25, the handle 26 (FIG. 5) must be unlocked in order to displace the movable workpiece receiving element 25 into its closest position relative to the stationary workpiece receiving element 23. In this set position—representing an adjustment for producing the smallest size of a collar—the set screws 44 (FIG. 6) are to be loosened for allowing rotation of the potentiometer 40 until the voltmeter indicates zero volt-potential. Subsequently, the handle 26 will be untightened for displacing the movable workpiece receiving element 25 into its farthest position in relation to the stationary workpiece receiving element 23, in order to adjust the required maximum voltage with respect to the AD-converter 60 by means of a not shown adjusting means within the power supply 57.

In accordance with the selected resistor values of the potentiometer 40 and the resistors 58 and 59 for protecting the potentiometer 40 against mechanical damage, the ratio of the rack 49 and pinion 47 is dimensioned so as to achieve nine revolutions at the potentiometer 40 over the displacement of the movable workpiece receiving element 25 through its total range of size adjustment.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What we claim is:

1. An automatic sewing machine for sewing workpieces of different size comprising: a sewing head having a needle and a sewing head drive; a workpiece receiving device having workpiece receiving elements adjustably arranged to each other for receiving workpieces of different sizes; a drive system including drive means for generating relative movement between a workpiece and said needle in two rectangular coordinate directions; and a programmable control system for controlling said sewing head drive and said drive means to produce a stitched contour in the workpiece, said control system including input means for receiving information about said size adjustment of said workpiece receiving elements and comprising: a measuring device for steadily detecting said size adjustment of said workpiece receiving elements, and connecting means connecting said measuring device with said control system for automatically transferring size information.

2. An automatic sewing machine according to claim 1, wherein said workpiece receiving device further includes: a bracket, said workpiece receiving elements comprising a stationary workpiece receiving element fastened to said bracket, and a movable workpiece receiving element adjustably arranged at said bracket.

3. An automatic sewing machine for sewing workpieces of different sizes comprising: a sewing head having a needle, and a sewing head drive; a workpiece receiving device having a bracket, a stationary workpiece receiving element fastened to said bracket, and a movable workpiece receiving element adjustably arranged at said bracket for receiving workpieces of different sizes; a drive system including drive means for generating relative movement between a workpiece and said needle in two rectangular coordinate directions; and a programmable control system for controlling said sewing head drive and said drive means to produce a stitched contour in said workpiece, said control system including: input means for receiving information about said size adjustment of said workpiece receiving elements and comprising: a measuring device having a metering element arranged at said bracket and connected to said movable workpiece receiving element by drive elements for steadily detecting said size adjustment of said workpiece receiving device, and connecting means connecting said metering element with said control system for automatically transferring size information.

4. An automatic sewing machine according to claim 3, wherein said metering element comprises a potentiometer and said drive elements include a rack and pinion.

5. An automatic sewing machine according to claim 3, wherein said metering element of said measuring device connected to said control system by means of said connecting means comprises further a potentiometer having a linear information output related to said size adjustment of said workpiece receiving device.

6. An automatic sewing machine according to claim 5, wherein said connecting means comprises adapting electronic means including an AD-converter.

7. An automatic sewing machine for sewing workpieces of different sizes comprising: a sewing head having a needle, and a sewing head drive; a workpiece receiving device having a bracket, a stationary workpiece receiving element fastened to said bracket, and a movable workpiece receiving element adjustably arranged at said bracket for receiving workpieces of different sizes; a drive system including drive means for generating relative movement between a workpiece and said needle in two rectangular coordinate directions; and a programmable control system for controlling said sewing head drive and said drive means to produce a stitched contour in said workpiece, said control system including input means for receiving information about said size adjustment of said workpiece receiving elements and comprising: a measuring device having a potentiometer arranged at said bracket and having a shaft with a pinion cooperating with a rack movably arranged at said bracket and connected to said movable workpiece receiving element, said potentiometer providing linear information according to said size information; and connecting means connecting said potentiometer with said control system for automatically transferring size information, said connecting comprising adapting electronic means including an AD-converter.

8. An automatic sewing machine according to claim 7, wherein said adapting electronic means further comprises two resistors forming a bridge circuit in conjunction with said potentiometer.

* * * * *